US011280108B1

(12) United States Patent
Szepi

(10) Patent No.: US 11,280,108 B1
(45) Date of Patent: Mar. 22, 2022

(54) WATER DIVERTING GROUND PLATFORM

(71) Applicant: Shawn Szepi, Winona, MN (US)

(72) Inventor: Shawn Szepi, Winona, MN (US)

( * ) Notice: Subject to any disclaimer, the term of this patent is extended or adjusted under 35 U.S.C. 154(b) by 0 days.

(21) Appl. No.: 16/267,506

(22) Filed: Feb. 5, 2019

(51) Int. Cl.

| | |
|---|---|
| ***E04H 15/56*** | (2006.01) |
| ***E04F 15/024*** | (2006.01) |
| ***A47C 17/70*** | (2006.01) |
| ***A47C 17/64*** | (2006.01) |
| *E04H 15/32* | (2006.01) |

(52) U.S. Cl.
CPC ..... *E04H 15/56* (2013.01); *A47C 17/64* (2013.01); *A47C 17/70* (2013.01); *E04F 15/02411* (2013.01); *E04H 15/324* (2013.01); *Y10S 108/00* (2013.01)

(58) Field of Classification Search
CPC ..... E04H 15/324; E04H 15/56; A47C 17/46; A47C 17/70; A47C 17/64; E04F 15/02411
See application file for complete search history.

(56) References Cited

U.S. PATENT DOCUMENTS 4,109,954 A * 8/1978 Wall ..... B60P 3/341 135/88.13
4,436,779 A 3/1984 Menconi et al.
5,375,905 A * 12/1994 Flitter ..... A01K 97/22 297/15
5,615,521 A 4/1997 Simerka
6,047,663 A 4/2000 Moreau et al.
6,065,264 A 5/2000 Imler et al.
6,119,812 A * 9/2000 Chin ..... A01M 31/02 182/223
6,125,772 A * 10/2000 Clements ..... B60N 3/002 108/115
6,148,834 A 11/2000 Grooms, Sr.
6,192,909 B1 * 2/2001 Strausser ..... E04H 15/40 135/116
6,669,269 B1 * 12/2003 Tran-Ngoc ..... B60P 3/341 296/156
6,736,446 B1 * 5/2004 Johnson ..... B60P 3/36 296/162
6,968,652 B1 * 11/2005 Eadie ..... E04B 5/12 446/109
7,360,343 B1 * 4/2008 Spransy ..... E04F 15/02452 52/263
7,398,626 B2 7/2008 Greschbach
8,448,403 B1 5/2013 Wallace
8,459,516 B2 6/2013 O'Regan et al.
(Continued)

FOREIGN PATENT DOCUMENTS

DE 102013011933 A1 * 1/2015 ..... E04H 15/56
EP 0167509 A2 * 1/1986 ..... B66F 3/08
(Continued)

*Primary Examiner* — David R Dunn
*Assistant Examiner* — Danielle Jackson
(74) *Attorney, Agent, or Firm* — Cramer Patent & Design, PLLC; Aaron R. Cramer

(57) ABSTRACT

A water diverting ground platform includes a base plate having an interlocking edge, a plurality of tent stake apertures and a plurality of intersecting channels upon a first face. The device is configured to provide a water diverting platform for a structure such as a tent secured upon the top of the device. The interlocking nature of each platform permits a user to create as large a foundation as required by the tent of a user.

20 Claims, 5 Drawing Sheets

(56) References Cited

U.S. PATENT DOCUMENTS

| | | | | |
|---|---|---|---|---|
| 8,490,234 | B2 * | 7/2013 | Rowell | E04F 15/0247 14/2.4 |
| 8,671,963 | B2 * | 3/2014 | Shih | E04H 15/60 135/137 |
| 9,010,349 | B1 * | 4/2015 | Heacock | E04H 15/324 135/116 |
| 2007/0062147 | A1 * | 3/2007 | Wright | E04B 5/12 52/582.1 |
| 2008/0134944 | A1 * | 6/2008 | McCoy | A47B 91/005 108/38 |
| 2018/0014529 | A1 * | 1/2018 | Litwin | A01M 31/002 |
| 2019/0274298 | A1 * | 9/2019 | Peel | E04H 15/001 |

FOREIGN PATENT DOCUMENTS

| | | | | |
|---|---|---|---|---|
| EP | 1617016 | A1 * | 1/2006 | E04H 15/56 |
| WO | WO-2018013059 | A1 * | 1/2018 | E04H 15/54 |

* cited by examiner

I-I

WATER DIVERTING GROUND PLATFORM

FIELD OF THE INVENTION

The presently disclosed subject matter is directed to a water diverting ground platform base.

BACKGROUND OF THE INVENTION

Camping, hunting and other outdoor activities continue to be among today's most popular outdoor leisure activities. While different types of camping and different types of people will have different items in their camping equipment collection, just about all of these collections will have a tent to provide basic protection from the elements, and a surface to sleep upon. However, the basic tent provides little protection above that of sleeping directly on the hard ground.

As such, the user must deal with being invaded by insects, rodents, and even larger threats such as animals or snakes. Additionally, the hard ground can be very uncomfortable should it be comprised of sticks, rocks, tree roots, and other disturbances. Finally, should it rain while camping, the user is faced with mud and possible flooding while inside of the tent. Accordingly, there exists a need for means by which an increased level of comfort and safety can be provided to those sleeping in a tent. The development of the modular outdoor platform base fulfills this need.

SUMMARY OF THE INVENTION

The principles of the present invention provide for a modular outdoor platform base, comprising a flat platform surface having a plurality of platform sections interconnected by a plurality of continuous locking hinges. The continuous locking hinges are arranged in an alternating top and bottom configuration to allow the platform surface to fold or capsize in an accordion arrangement. A perimeter of the platform surface is provided with a plurality of attachment holes. The modular outdoor platform base also comprises a height adjustment mechanism which is provided on each of four outer corners of the platform surface. Each of four outer corners of the platform surface are each provided with a pole access penetration. The pole access penetration completely penetrates the platform sections and allow the corner pole to be anchored in the grade. The modular outdoor platform base also comprises an eyehook which is provided on the each of four outer corners of the platform surface. The securing eyehook secures the modular outdoor platform base to a grade to prevent it, along with any contents from being blown away.

The platform sections may be made of aluminum to provide structural rigidity to support loading. While the height adjustment mechanism may allow for leveling of the modular outdoor platform base on uneven terrain. The height adjustment mechanism may allow for avoiding rises and indentations in the terrain and/or for elevating the modular outdoor platform base.

The height adjustment mechanism may allow for avoiding ground-based insects, rodents, reptiles, and other wildlife while, may allow for movement of air under the modular outdoor platform base to facilitate cooling and may allow for keeping the modular outdoor platform base above water as a result of rain.

The height adjustment mechanism may include a threaded receiver that is permanently attached to an underside of the platform sections while a threaded rod may be rotationally attached to the threaded receiver and may or may not penetrate through an upper surface of the platform sections.

The height adjustment mechanism may comprise an adjustment crank is furnished to facilitate height adjustment of the height adjustment mechanism. The height adjustment mechanism may also attach to an uppermost end of the treaded rod in a friction fit manner. The height adjustment mechanism may be in the range of 1 to 6 inches in height. The attachment holes may be used to attach a tent, a tarp, or a guy line and the attachment holes may be connected to a rope, an elastic cord, a bungee cord, or a ratcheting clamp. An edge of the platform sections may be provided with an upper lapped edge and an accompanying downward facing protrusion. A boundary of the upper lapped edge and the lower lapped edge may provide a smooth trip-free junction between adjacent sections of platform sections. Each of the pole access penetrations support a corner pole of a dining canopy, a sun cover, a rain cover, or other portable shelter utilized in an outdoor environment. The modular outdoor platform base may be ten feet wide and/or fifteen feet long.

BRIEF DESCRIPTION OF THE DRAWINGS

Description of the Invention

The advantages and features of the present invention will become better understood with reference to the following more detailed description and claims taken in conjunction with the accompanying drawings, in which like elements are identified with like symbols, and in which:

DESCRIPTIVE KEY

Figure 1:
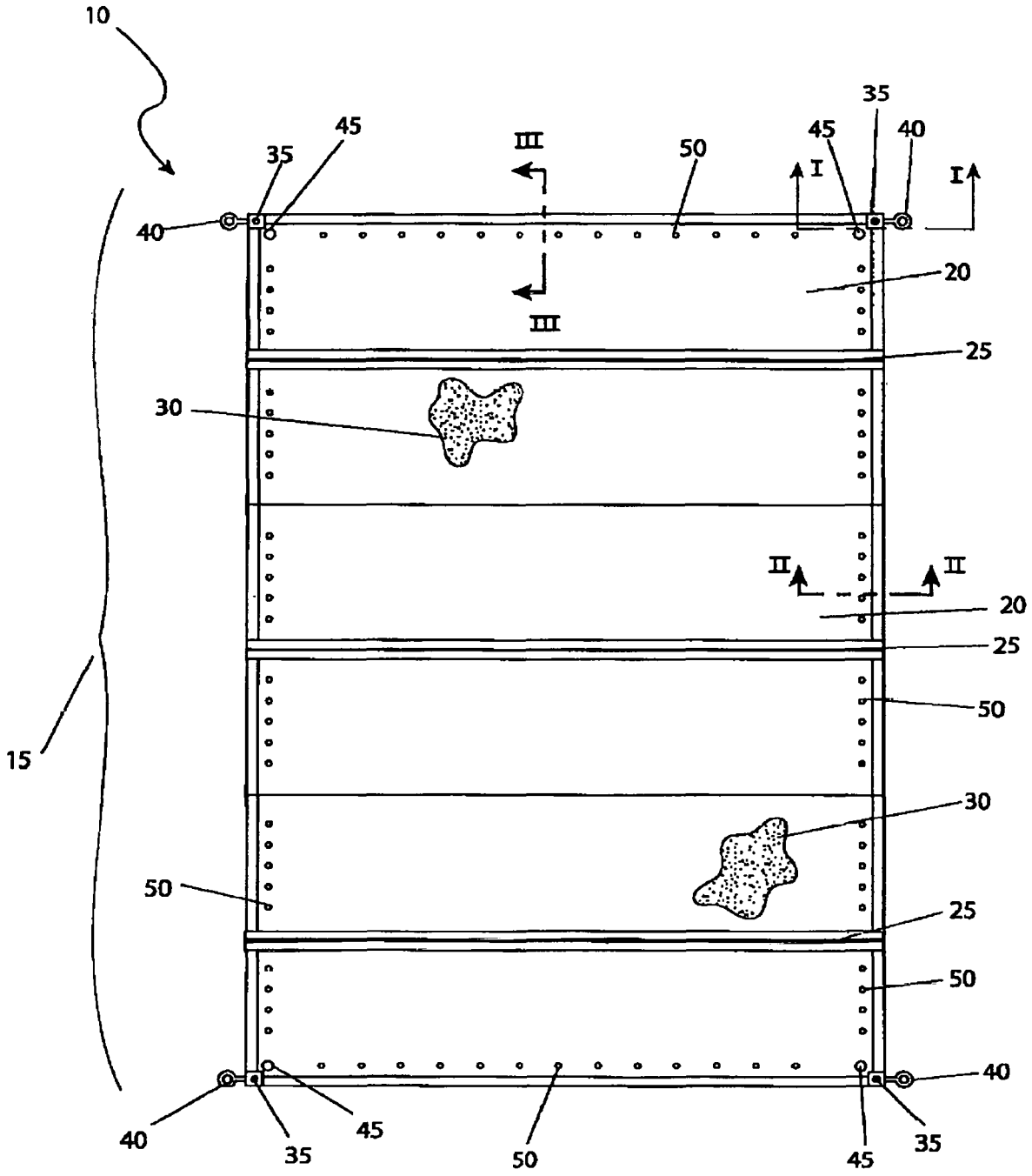
FIG. 1 is a top view of the modular outdoor platform base 10, according to the preferred embodiment of the present invention.

10 modular outdoor platform base
15 platform surface
20 platform section
25 continuous locking hinge
30 perforations
35 height adjustment mechanism
40 securing eyehook
45 pole access penetration
50 attachment hole
55 grade surface
60 threaded receiver
65 threaded rod
70 load bearing foot

75 adjustment crank
80 travel path "t"
85 rotational travel path "r"
90 upper lapped edge
95 protrusion
100 lower lapped edge
105 receptacle
115 outdoor temporary structure
120 securing devices
125 tie down straps
130 ground stakes
135 upper structure
140 support poles

DESCRIPTION OF THE PREFERRED EMBODIMENTS

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a top view of the modular outdoor platform base 10, according to the preferred embodiment of the present invention is disclosed. The modular outdoor platform base 10 (herein also described as the "device") 10, includes a platform surface 15 that is flat in nature. While the exact overall size is not a limiting factor of the present invention, a typical size, sufficient to use with a conventional tent or hunting blind is envisioned to be approximately ten feet (10 ft.) wide and fifteen feet (15 ft.) long.

The platform surface 15 preferably comprises multiple platform sections 20, here shown in a quantity of six (6) that are interconnected by five (5) continuous locking hinges 25, of which only three (3) are visible due to illustrative limitations. The quantity of continuous locking hinges 25 would be equal to the quantity of n−1 (where "n" is the quantity of platform sections 20). The continuous locking hinges 25 are arranged in an alternating top and bottom configuration to allow the platform surface 15 to fold or capsize in an accordion, or zig-zag arrangement which will be described in greater detail herein below. Each of the platform sections 20 is envisioned to be manufactured from aluminum to provide structural rigidity to support loading of tent, materials, people and the like. It may be coated in plastic to prevent corrosion, physical damage and allow for easy cleaning. All upper surfaces would be provided with perforations 30 (here partially shown for simplification). These perforations 30 allow for drainage of rain water and allow for air circulation from below.

Each of the four (4) outer corners of the platform surface 15 is each provided with a height adjustment mechanism 35. The height adjustment mechanism 35, to be described in greater detail herein below, allows for the adjustment of the height of the platform surface 15 over the grade upon which it is set. While the adjustment height range is not a limiting factor of the present invention, a typical adjustment range is envisioned to be one to six inches (1-6 in.). This adjustment range provides the following functionality; allow for leveling of the device 10 on uneven terrain, avoid rises and indentations in the terrain, elevate the device 10 above rocks, branches, and other obstructions, avoid ground based insects, rodents, reptiles, and other wildlife, allow for movement of air under the device 10 to facilitate cooling, and keep the device 10 above water as a result of rain.

Each of the four (4) outer corners of the platform surface 15 are each provided with a securing eyehook 40. The securing eyehook 40 is used to secure the device 10 to the grade to prevent it, along with any contents from being blown away. Further description on the use of the securing eyehook 40 will be provided herein below. Each of the four (4) outer corners of the platform surface 15 is each provided with pole access penetrations 45. The pole access penetrations 45 may be used to support corner poles of dining canopies, sun/rain covers or any other portable shelter used in an outdoor environment. The pole access penetrations 45 completely penetrate the platform sections 20 and allow the corner pole to be anchored in the grade below. The entire perimeter of the platform surface 15 is provided with a plurality of attachment holes 50 for the purposes of attaching tents, tarps, guy lines, and other similar items. Connection to the attachment holes 50 would be made by rope, elastic cord, bungee cords, ratcheting clamps or other like method.

Figure 2:
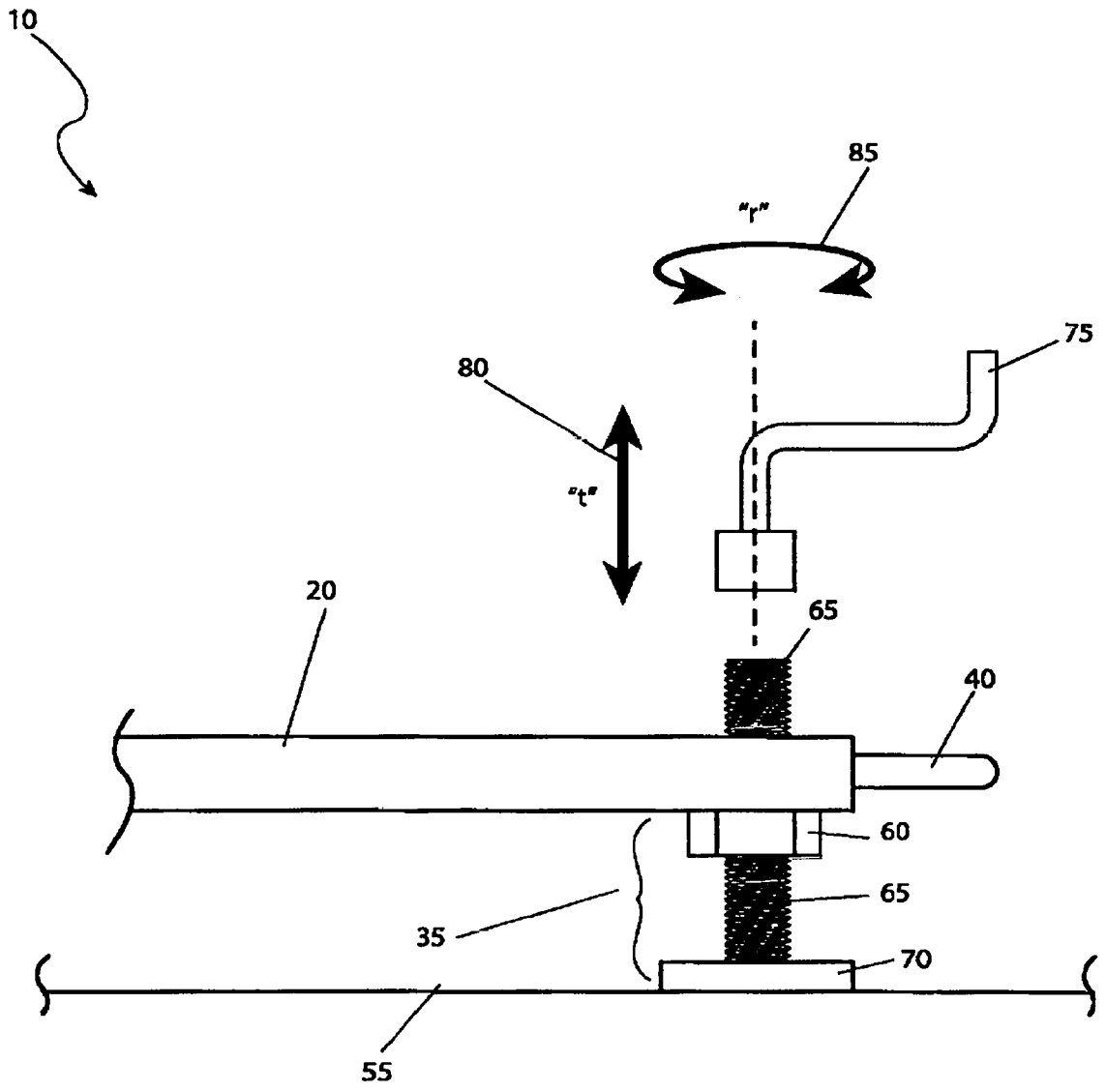
FIG. 2 is a sectional view of the modular outdoor platform base 10, as seen along a line I-I, as shown in FIG. 1, according to the preferred embodiment of the present invention.

Referring next to FIG. 2, a sectional view of the device 10, as seen along a line I-I, as shown in FIG. 1, according to the preferred embodiment of the present invention is depicted. This figure discloses the platform sections 20 in a general horizontal arrangement that is generally parallel to a grade surface 55. The height adjustment mechanisms 35 includes a threaded receiver 60 that is permanently attached to the underside of the platform sections 20. A threaded rod 65, envisioned to be approximately eight inches (8 in.) long, is rotationally attached to the threaded receiver 60, and may or may not penetrate through the plane of the upper surface of the platform sections 20. An adjustment crank 75 may be furnished to facilitate adjustment of the height of the height adjustment mechanism 35 it attaches to the uppermost end of the threaded rod 65 by way of a travel path "t" 80 in a friction fit manner. Then, by turning or cranking the adjustment crank 75 along a rotational travel path "r" 85, the height of the platform sections 20 with respect to the grade surface 55 is adjusted.

Figure 3:
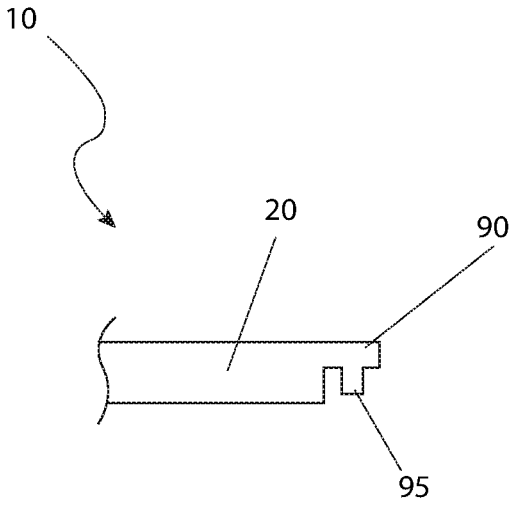
FIG. 3 is a sectional view of the modular outdoor platform base 10, as seen along a line II-II, as shown in FIG. 1, according to the preferred embodiment of the present invention.

Referring now to FIG. 3, a sectional view of the device 10, as seen along a line II-II, as shown in FIG. 1, according to the preferred embodiment of the present invention is shown. This figure provides disclosure on the ability of the device 10 to be interconnected with other device 10 to form larger platforms such as may be needed for large family style tents, large dining canopies, deck structures and the like. The edge of the platform sections 20 is provided with an upper lapped edge 90 and an accompanying downward facing protrusion 95. Further disclosure on the attachment method will be provided herein below.

Figure 4:
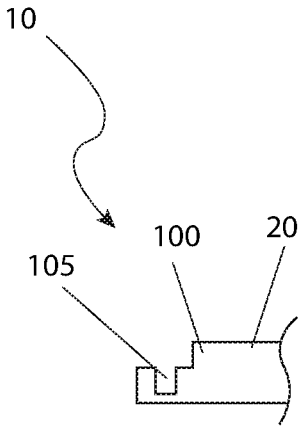
FIG. 4 is a sectional view of the modular outdoor platform base 10, as seen along a line III-III, as shown in FIG. 1, according to the preferred embodiment of the present invention.

Referring next to FIG. 4, a sectional view of the device 10, as seen along a line III-III, as shown in FIG. 1, according to the preferred embodiment of the present invention is disclosed. In a manner continuous and related to that aforementioned described in FIG. 3, the platform sections 20 is provided with a lower lapped edge 100 which mates with the upper lapped edge 90 (as shown in FIG. 3) and an accompanying receptacle 105 which mates with the protrusion 95 (as shown in FIG. 3). As such, the boundary of the upper lapped edge 90 (as shown in FIG. 3) and the lower lapped edge 100 will provide a smooth trip-free junction between adjacent sections of platform sections 20.

Figure 5:
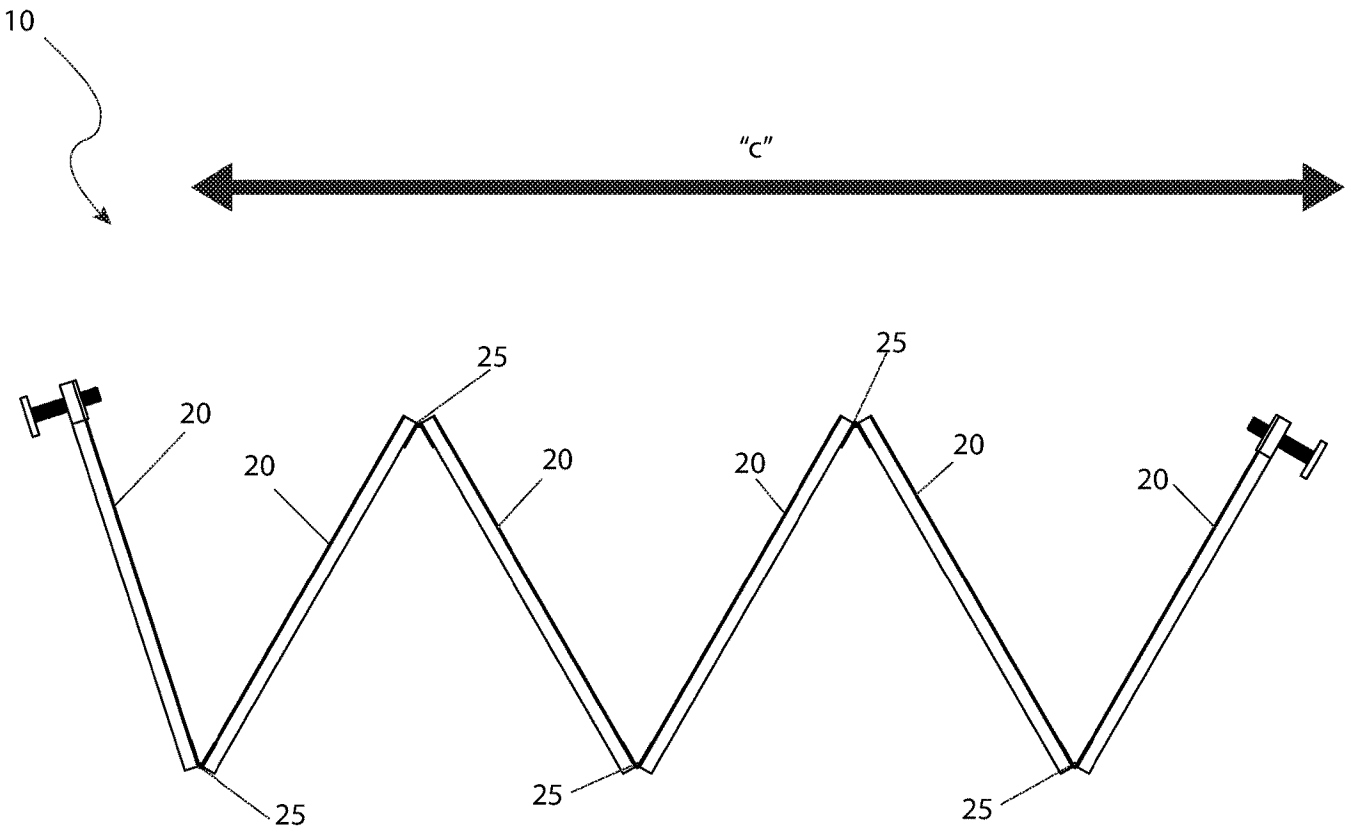
FIG. 5 is a side view of the modular outdoor platform base 10, shown in a partially collapsed state, according to the preferred embodiment of the present invention; and, FIG. 6 is a perspective view of the modular outdoor platform base 10, shown in a utilized state, according to the preferred embodiment of the present invention.

Referring now to FIG. 5, a side view of the modular outdoor platform base 10, shown in a partially collapsed state, according to the preferred embodiment of the present invention is depicted. The folding nature of the continuous locking hinges 25 allow for the various sections of the platform sections 20 to fold or collapse together for the purposes of travel and/or storage. After unlocking the continuous locking hinges 25 the user would fold each adjacent section of platform sections 20 to each other in an alternating fashion. This motion would occur along a collapsing travel path "c" 110. This motion would be reversed during setup or use of the device 10. It is envisioned that the folded device 10 would be provided with securing straps (not shown) or a travel case (not shown) to facilitate storage and transfer.

Figure 6:
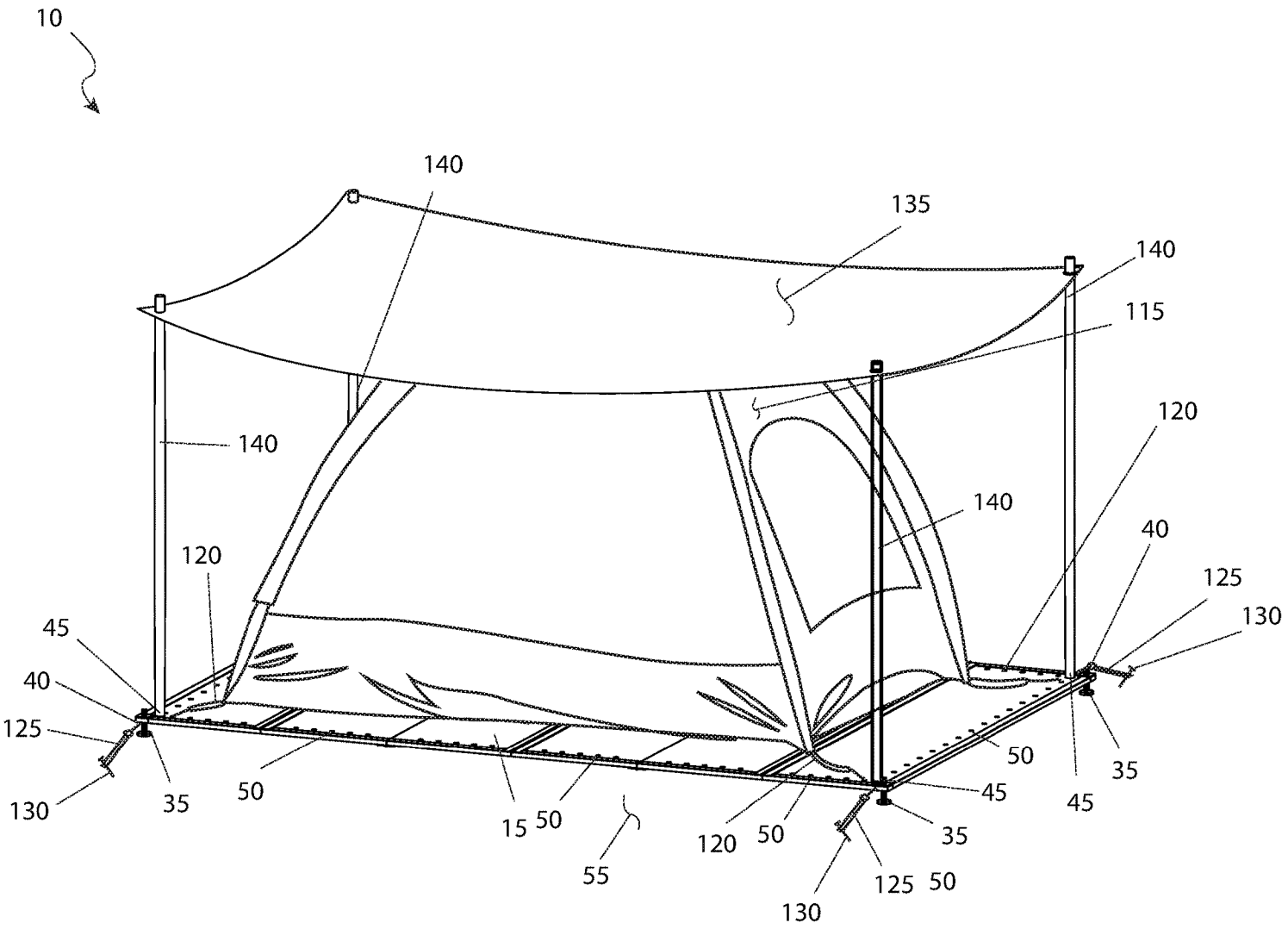

Referring finally to FIG. 6, a perspective view of the device 10, shown in a utilized state, according to the preferred embodiment of the present invention is shown. An outdoor temporary structure 115, here depicted as a tent, is placed upon the device 10. At least four (4) securing devices 120, of which only three (3) are shown due to illustrative limitations, are used to secure the outdoor temporary structure 115 via use of the nearest attachment holes 50. The height adjustment mechanisms 35 are adjusted as aforementioned described to provide an elevated surface above the attachment holes 50. Once properly orientated by use of the height adjustment mechanism 35, the platform surface 15 is secured in place by attaching tie down straps 125 between each of the securing eyehook 40 and an independent ground stakes 130. An upper structure 135 such as a rain tarp may be supported on support poles 140 inserted into the pole access penetrations 45 if desired. This upper structure 135 may also be used with or without the outdoor temporary structure 115.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 6. The user would procure the device 10 through normal procurement channels while paying attention to specifics such as overall size of the platform surface 15, ability to connect to existing device 10, and the like.

After procurement and prior to utilization, the device 10 would be prepared in the following manner: the user would unfold the platform sections 20 and lock the continuous locking hinges 25 into place to form a continuous platform surface 15; it would be set upon the desired grade surface 55; each height adjustment mechanism 35 would be adjusted to position the platform surface 15 above grade to the desired manner; any other device 10 would be connected via the upper lapped edge 90, the protrusion 95, the lower lapped edge 100, and the receptacle 105; and an outdoor temporary structure 115 or upper structure 135 may be attached to the device 10 using the attachment holes 50 and the pole access penetrations 45 respectively.

During utilization of the device 10, the following procedure would be initiated: the outdoor temporary structure 115 and/or the upper structure 135 would be utilized following conventional practices and procedures without worry of the underlying grade surface 55 and its undesired characteristics such as unevenness, insects, rodents, protrusions, wetness or the like.

After use of the device 10, the outdoor temporary structure 115 and the upper structure 135 is removed if utilized, the height adjustment mechanism 35 removed or retracted, the continuous locking hinges 25 unlocked, the platform sections 20 folded together in general conformance with FIG. 5, and the device 10 secured for transport or storage.

In general, the device 10 increases comfort and provides isolation between user activities and the adjacent grade surface 55. Other applications include but are not limited to use as a hunting blind, used as a platform for lawn chairs in a backyard, at an outdoor sporting or entertainment event, used at a beach to place beach towels upon, for use as a teeing surface in golf or Frisbee golf, or any other activity where the needed grade surface 55 presents an undesirable attribute that can be remedied by the isolation properties of the present invention.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A modular outdoor platform base, comprising:

a flat platform surface having a plurality of platform sections interconnected by a plurality of continuous locking hinges, said continuous locking hinges are arranged in an alternating top and bottom configuration to allow the flat platform surface to fold or capsize in an accordion arrangement and a perimeter of said flat platform surface is provided with a plurality of attachment holes;

a height adjustment mechanism provided on each of four outer corners of said flat platform surface, said each of four outer corners of said flat platform surface are each provided with a pole access penetration, each said pole access penetration completely penetrates said plurality of platform sections and allows a corner pole to be anchored in a grade; and an eyehook provided on said each of four outer corners of said flat platform surface, each said eyehook secures said modular outdoor platform base to said grade to prevent said modular outdoor platform base from being blown away.

2. The modular outdoor platform base according to claim 1, wherein said plurality of platform sections are made of aluminum to provide structural rigidity to support loading.

3. The modular outdoor platform base according to claim 1, wherein said height adjustment mechanism allows for leveling of said modular outdoor platform base on uneven terrain.

4. The modular outdoor platform base according to claim 1, wherein said height adjustment mechanism allows for avoiding rises and indentations in a terrain.

5. The modular outdoor platform base according to claim 1, wherein said height adjustment mechanism allows for elevating said modular outdoor platform base.

6. The modular outdoor platform base according to claim 1, wherein said height adjustment mechanism allows for avoiding ground-based insects, rodents, reptiles, and other wildlife.

7. The modular outdoor platform base according to claim 1, wherein said height adjustment mechanism allows for movement of air under said modular outdoor platform base to facilitate cooling.

8. The modular outdoor platform base according to claim 1, wherein said height adjustment mechanism allows for keeping said modular outdoor platform base above water as a result of rain.

9. The modular outdoor platform base according to claim 1, wherein said height adjustment mechanism includes a threaded receiver that is permanently attached to an underside of said plurality of platform sections.

10. The modular outdoor platform base according to claim 9, wherein a threaded rod is rotationally attached to said threaded receiver and may or may not penetrate through an upper surface of said plurality of platform sections.

11. The modular outdoor platform base according to claim 1, wherein said height adjustment mechanism attaches to an uppermost end of said threaded rod in a friction fit manner.

12. The modular outdoor platform base according to claim 10, wherein said height adjustment mechanism is an adjustment crank which facilitates a height adjustment of said modular outdoor platform base.

13. The modular outdoor platform base according to claim 1, wherein said height adjustment mechanism is in the range of 1 to 6 inches in height.

14. The modular outdoor platform base according to claim 1, wherein said attachment holes are used to attach a tent, a tarp, or a guy line.

15. The modular outdoor platform base according to claim 14, wherein said attachment holes are connected to a rope, an elastic cord, a bungee cord, or a ratcheting clamp.

16. The modular outdoor platform base according to claim 1, wherein an edge of said plurality of platform sections are provided with an upper lapped edge and an accompanying downward facing protrusion.

17. The modular outdoor platform base according to claim 16, wherein a boundary of said upper lapped edge and a lower lapped edge will provide a smooth trip-free junction between adjacent sections of said plurality of platform sections.

18. The modular outdoor platform base according to claim 1, wherein each said pole access penetrations supports one of said corner poles, wherein said corner poles are part of a dining canopy, a sun cover, a rain cover, or other portable shelter utilized in an outdoor environment.

19. The modular outdoor platform base according to claim 1, wherein said modular outdoor platform base is ten feet wide.

20. The modular outdoor platform base according to claim 1, wherein said modular outdoor platform base is fifteen feet long.

* * * * *